United States Patent [19]

Lemieux

[11] 4,091,599

[45] May 30, 1978

[54] COIN COUNTING AND PACKAGING DEVICE

[76] Inventor: Roger Joseph Lemieux, 91 Sommervale Ave., Pointe Claire, Quebec, Canada, H9R 3H6

[21] Appl. No.: 807,048

[22] Filed: June 16, 1977

[51] Int. Cl.[2] ..... B65B 39/00; B65B 67/02

[52] U.S. Cl. ..... 53/254; 53/213; 133/1 A

[58] Field of Search ..... 53/254, 213; 133/1 R, 133/1 A, 8 A

[56] References Cited

U.S. PATENT DOCUMENTS

| | | | |
|---|---|---|---|
| 2,554,713 | 5/1951 | McKoy | 53/213 |
| 3,107,467 | 10/1963 | Gates | 53/254 |

*Primary Examiner*—Travis S. McGehee

[57] ABSTRACT

A coin counting and packaging device is disclosed which comprises a tubular body having at its receiving end a semi-circular scoop and at its counting end a circular coin chamber to hold a column of coins. At the terminal end of the coin chamber a stopper means, which may be adjustable, is provided to support the coins in the chamber and to define a length of chamber for a prescribed number of coins to be counted and packaged. Standard paper wrapping tubes or wrapping sheets formed into tubes may be used in conjunction with the device for the purpose of wrapping the coins into a compact stack. The device of the present invention is most useful for counting and packaging coins without the necessity of counting the coins mentally prior to wrapping them, and reducing the dexterity required on the part of the wrapper to package them.

8 Claims, 5 Drawing Figures

COIN COUNTING AND PACKAGING DEVICE

The present invention relates to a coin counting and packaging device which is particularly useful as a portable device for counting and packaging coins in banks, loan associations, commercial establishments and other places of business where coins of various denominations are handled during daily business transactions. It is particularly useful for saving time and labour while providing error-proof counting and efficient packaging means.

Briefly, the device herein described is simple, practical and efficient and of such construction that it can be mass produced from plastic materials, metal or any other suitable material of substantial rigidity that can be formed into a hollow tube.

Known means for counting and packaging coins vary from sophisticated combination coin sorting, counting and packaging machines which usually include expensive and complicated mechanical and/or electrical components to the well known hand counting and manual wrapping of coins in paper sheet or tube wrappers. This latter method is relatively slow and tedious as it usually necessitates mental counting of the coins prior to packaging as well as manual dexterity when handling and wrapping.

In accordance with the present invention, a device is provided which eliminates the need for mental counting of the coins prior to or during wrapping and also provides a simple means for packaging with a substantial reduction in the manual dexterity required on the part of the packager. More particularly, the present invention contemplates the use of a device comprising, in its simplest form, a hollow tubular body of substantially circular cross-section having an open scoop at a receiving end and a coin stopper at the other end; the tubular body being adapted to receive coins of a predetermined denomination. The tubular portion between the scoop and the stopper constitutes self-counting means when the tube is filled with coins. Wrapping is accomplished by inserting a tubular paper or plastic wrapper over the coins in the tubular body such that the tube wrapper overlaps both ends of the coin stack and with the use of finger pressure, folding the overlapping ends of the tube wrapper to form a compact package of coins.

Other objects and advantages will become apparent from the details of construction and operation as more fully hereinafter described with reference to the accompanying drawings in which.

Figure 1:
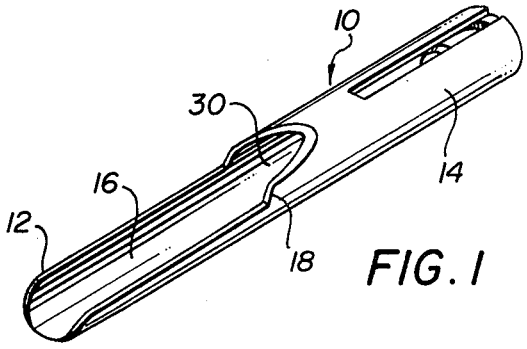
FIG. 1 is a view in perspective of a coin counting and packaging device according to an example embodiment of the present invention.
Figure 2:
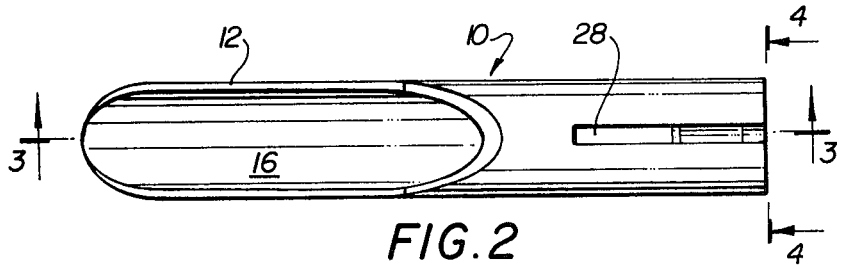
FIG. 2 is a cross-sectional view of the device taken along line 2—2 of FIG. 1.
Figure 3:
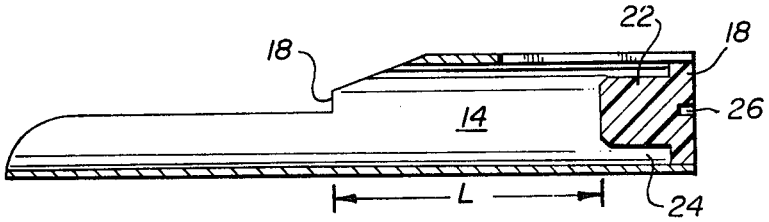
FIG. 3 is another cross-sectional view of the device taken along line 3—3 of FIG. 2.
Figure 4:
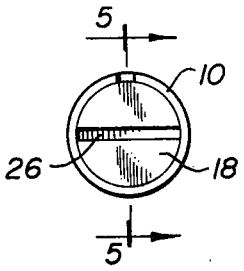
FIG. 4 is a further cross-sectional view taken along line 4—4 of FIG. 2 showing the stopper end portion of the device.
Figure 5:
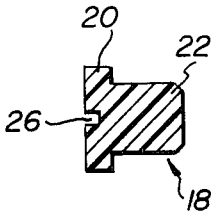
FIG. 5 is a cross-sectional view of a suitable stopper taken along line 5—5 of a FIG. 4.

In operation, the device of the present invention is held in ones hand at or on about the coin chamber portion 14 and at a positive angle to the horizontal such that the scoop 16 is at a slightly higher elevation than the coin chamber 14. Coins of the same denomination are then fed into scoop 16 at random and by simply shaking or slightly vibrating the device, the coins advance into chamber 14 and generally tend to align themselves at right angles to the longitudinal axis of the device to form a column of coins. Slot 28 provides a visual means for ensuring proper alignment of the coins in chamber 14. Once the chamber 14 appears to be filled, the device is brought to a vertical position at which point the coin column is visually compared against edge 18. Any coin extending beyond edge 18 into scoop 16 is simple removed laterally of the device, whereas if the column does not extend to edge 18, coins are simply added. It can be seen therefore that once length L has been set for a prescribed number of coins, a full chamber constitutes the exact number of coins required without the need of manually counting them, thus constituting self counting means.

Coins are generally packaged in paper tubes or in specially designed paper sheets in which the coins are roll-wrapped. The device of the present invention has been conceived to make use of these well known and commercially available wrapping mediums without the need for manually rolling the coins therein. Of course other wrapping mediums may be used without departing from the scope of the present invention.

In essence, once the coin chamber 14 is full, and thus containing the prescribed number of coins, the device is tilted to a near horizontal position to cause the coins to lie at an angle to the longitudinal axis of chamber 14. It will be appreciated that in this manner, the effective cross-sectional area of the coin column is reduced, and will facilitate the quick and simple insertion of the coin wrapping medium thereover.

In the case where paper tubes are used, these are inserted over the coin column in chamber 14 until the leading end of the tube reaches flange 20 of stopper 18 through space 24 as previously described. It will be seen, therefore, that the leading portion of the tube occupying space 24 will in effect overlap the coin column by a length equal to the length of the protruding portion of stopper 18. Similarly the lagging end of the wrapping tube will overlap the coin column at the opposite end by substantially the same amount. This, in effect, constitutes self-centering means for the wrapping medium.

By means of finger slot 30, finger pressure may be applied to the overlapping portion of the lagging end of the tube wrapper and thus fold a portion thereof over the coin column. The partially wrapped coin column can then be displaced toward scoop 16 by tilting the device and again using finger pressure on the overlapping portion of the leading end of the tube wrapper to fold it over the coin column to form a compact stack of wrapped coins.

In the case where paper sheets are employed, these can be pre-rolled into a tube having an outer diameter slightly less than that of coin chamber 14. The formed tube is then inserted into chamber 14 whereupon inherent stresses in the rolled tube will cause it to conform to the inner diameter of the coin chamber. The same procedure employed with the tube wrappers can be used to complete the wrapping process.

It will be understood by those skilled in the art that different size devices are contemplated for use to accomodate different coin denominations.

It will also be obvious to those skilled in the art that the inner diameter of the device must be at least slightly larger than the diameter of the coins to be counted and packaged.

It will further be understood that a notch or other similar means inscribed on the tubular body or scoop may be used to denote a full chamber instead of edge 18.

Also, other forms of stopper means may be used without departing from the scope of the present invention.

Furthermore, the present invention contemplates a device which may be used for self-counting and packaging of articles other than coins such as poker chips or other disc-like articles.

I claim:

1. A portable coin counting and packaging device for use with a tubular wrapping medium comprising:

a hollow tubular body of substantially circular cross-section adapted to receive coins of a predetermined denomination, said tubular body having at its receiving end a portion thereof removed along its longitudinal axis to form a scoop of substantially semi-circular cross-section, and having at its other end stopper means, a portion of which protrudes within said tubular body, said protruding portion of said stopper means having a diameter less than the inside diameter of said tubular body to provide a space there between, said portion of said tubular body between the end of said semi-circular scoop and the end of said protruding stopper means defining a chamber for holding a prescribed number of coins and when full, constituting self-counting means.

2. A device as defined in claim 1 wherein the material of said tubular body is a metal.

3. A device as defined in claim 1 wherein the material of said tubular body is a polymer.

4. A device as defined in claim 1 wherein said tubular body includes a coin observation slot.

5. A device as defined in claim 1 wherein said stopper means is adjustable.

6. A device as defined in claim 1 wherein the diameter of said protruding portion of said stopper is such as to permit passage of said wrapping medium between it and said tubular body.

7. A device as defined in claim 1 wherein said stopper means protrudes within said tubular body a distance sufficient to provide self-centering means for said wrapping medium.

8. A device as defined in claim 1 wherein said self-counting means comprises a notch inscribed on said tubular body.

* * * * *